US005570779A

United States Patent [19]

Draucker et al.

[11] Patent Number: 5,570,779

[45] Date of Patent: Nov. 5, 1996

[54] STEP-SHAPED INNERFRAME FOR USE WITH SHORT CIGARETTES AND HINGED LID BOX

[75] Inventors: James B. Draucker, Chesterfield; Charles D. Hansen, Jr., Richmond; Reginald W. Newsome, Richmond; Xuan M. Pham, Richmond, all of Va.

[73] Assignee: Philip Morris Incorporated, New York, N.Y.

[21] Appl. No.: 514,526

[22] Filed: Aug. 14, 1995

Related U.S. Application Data

[62] Division of Ser. No. 161,495, Dec. 6, 1993, Pat. No. 5,480,025.

[51] Int. Cl.[6] ..... B65D 85/10; A24F 15/00

[52] U.S. Cl. ..... 206/246; 206/256; 206/273

[58] Field of Search ..... 206/242, 248, 206/252, 256, 268, 271, 273, 246; 229/160.1, 87.13

[56] References Cited

U.S. PATENT DOCUMENTS

| | | | |
|---|---|---|---|
| 2,818,970 | 1/1958 | Pough . | |
| 2,999,584 | 9/1961 | Gillespie . | |
| 3,395,787 | 8/1968 | Plaskan . | |
| 4,216,898 | 8/1980 | Davies | 206/273 X |
| 4,753,384 | 6/1988 | Focke et al. | 206/271 X |
| 4,771,882 | 9/1988 | Lowe et al. | 206/271 X |
| 4,850,482 | 7/1989 | Campbell | 206/271 X |
| 4,852,734 | 8/1989 | Allen et al. . | |
| 4,886,161 | 12/1989 | Keidar et al. | 206/246 |
| 4,949,841 | 8/1990 | Focke et al. . | |
| 4,961,496 | 10/1990 | Focke et al. . | |
| 4,989,728 | 2/1991 | Neyret et al. | 206/273 X |
| 5,074,412 | 12/1991 | White . | |
| 5,129,513 | 7/1992 | David et al. | 206/265 |
| 5,150,720 | 9/1992 | Focke et al. | 206/273 X |
| 5,158,178 | 10/1992 | Cobler | 206/256 |
| 5,158,664 | 10/1992 | Colgan | 206/268 X |
| 5,160,024 | 11/1992 | Evers . | |
| 5,314,062 | 5/1994 | Wu et al. | 206/268 |

FOREIGN PATENT DOCUMENTS

| | | |
|---|---|---|
| 448580 | 6/1936 | United Kingdom . |
| 522469 | 6/1940 | United Kingdom . |

*Primary Examiner*—Jacob K. Ackun

*Attorney, Agent, or Firm*—James T. Moore; James E. Schardt; Charles E. B. Glenn

[57] ABSTRACT

Step-shaped innerframes and blanks for forming such innerframes are provided to permit shorter than conventional cigarettes to be packaged in a conventionally sized hinged lid box. A front panel is foldably connected to a substantially perpendicular step bottom panel which in turn is foldably connected to a substantially perpendicular back panel, such that the front and back panels extend in opposite directions and lie in substantially parallel planes to form an integral step configuration. When the inner frame is located within a hinged lid box, a receptacle is formed for a short cigarette bundle. A lower receptacle is defined below the step bottom panel to store discarded cigarettes which are inserted into the lower receptacle via a hole located in one of the box walls and any associated underlying innerframe panel. Preferably, the innerframe is provided with oppositely located side walls which are provided with biasing members which exert an inwardly directed force toward the cigarette bundle located within the upper receptacle to prevent cigarettes from falling as other cigarettes are removed. Suitable blanks are provided to form the step-shaped innerframes.

51 Claims, 5 Drawing Sheets

STEP-SHAPED INNERFRAME FOR USE WITH SHORT CIGARETTES AND HINGED LID BOX

This is a divisional of application Ser. No. 08/161,495 filed on Dec. 6, 1993, now U.S. Pat. No. 5,480,025.

BACKGROUND OF THE INVENTION

1. Technical Field of the Invention

The present invention relates generally to packaging for individual cigarettes and more particularly to step-shaped innerframes for packaging short cigarettes in a hinged lid box and the blanks for forming such step-shaped innerframes.

2. Discussion of the Related Art

It is often desired to package vertically oriented cigarettes which are shorter than a conventional cigarette in a conventionally sized hinged lid box. The circumference of most popular cigarettes is approximately 25 mm and the length is approximately 70 mm for Regular cigarettes, approximately 83 mm for King-Size cigarettes, approximately 98.5 mm for a Super-King Size or 100, and approximately 120 mm for Long or 120 cigarettes. Shorter cigarettes having a conventional circumference and a length of, e.g., over half the currently popular cigarette lengths, e.g., approximately 58 mm, are desirable, e.g., in an electrically powered flavor generating article such as that described in commonly assigned U.S. patent application Ser. No. 08/105,346 filed Aug. 10, 1993, which is hereby incorporated by reference. These "short" cigarettes, e.g., twenty short cigarettes arranged in a conventional configuration of, e.g., front and middle rows of seven cigarettes and a back row of six cigarettes, are configured into a bundle conventionally wrapped with a foil or paper. This bundle of short cigarettes requires further packaging in a box or pack, e.g., a so-called hard pack configured as a hinged lid box, for transportation and displaying of product information. Mandatory tax stamping is required on a top or bottom portion of the box. Conventional tax stamping machines are designed to handle conventional length hinged lid boxes and would need to be redesigned to handle the short cigarette bundles contained in correspondingly short boxes.

It is accordingly an object of the present invention to permit short cigarette bundles to be taxed-stamped by conventional tax stamping machines designed to handle larger conventional hinged lid boxes.

It is another object of the present invention to provide mechanical strength for short cigarette bundles by permitting them to be packaged in conventional hinged lid boxes.

It is a further object of the present invention to provide an insert for use with a conventional hinged lid box that permits a short cigarette bundle to be packaged within the hinged lid box.

It is a further object of the present invention to provide a blank for forming an innerframe to permit a short cigarette bundle to be packaged within a conventional hinged lid box.

It is another object of the present invention to improve the disposal of short cigarettes packaged within a conventional hinged lid box.

It is a further object of the present invention to modify a conventional hinged lid box to package a short cigarette bundle.

It is another object of the present invention to accomplish the foregoing objects using a minimum of materials.

Other objects and advantages of the present invention are apparent from the specification and drawings which follow.

SUMMARY OF THE INVENTION

The foregoing and additional objects are obtained by step-shaped innerframes and blanks for forming such innerframes according to the present invention. A front panel is foldably connected to a substantially perpendicular step bottom panel which in turn is foldably connected to a substantially perpendicular back panel, such that the front and back panels extend in opposite directions and lie in substantially parallel planes to form an integral step configuration. When located within a hinged lid box, a receptacle is formed for a short cigarette bundle by the step bottom panel and front panel of the innerframe and upper portions of the back and side walls of the box, or by the step bottom panel and the back panel of the innerframe and upper portions of the front and side walls of the box. A lower receptacle is defined below the step bottom panel to store discarded cigarettes which are inserted into the lower receptacle via a hole located in one of the box walls and any associated underlying innerframe panel. Preferably, the innerframe is provided with oppositely located side walls which are substantially perpendicular to both the front and back walls as well as to the bottom step panel. The side panels may be provided with biasing members which exert an inwardly directed force toward the cigarette bundle located within the upper receptacle to prevent cigarettes from falling as other cigarettes are removed. Blanks are provided to form these step-shaped innerframes.

DETAILED DESCRIPTION OF THE INVENTION

Figure 1:
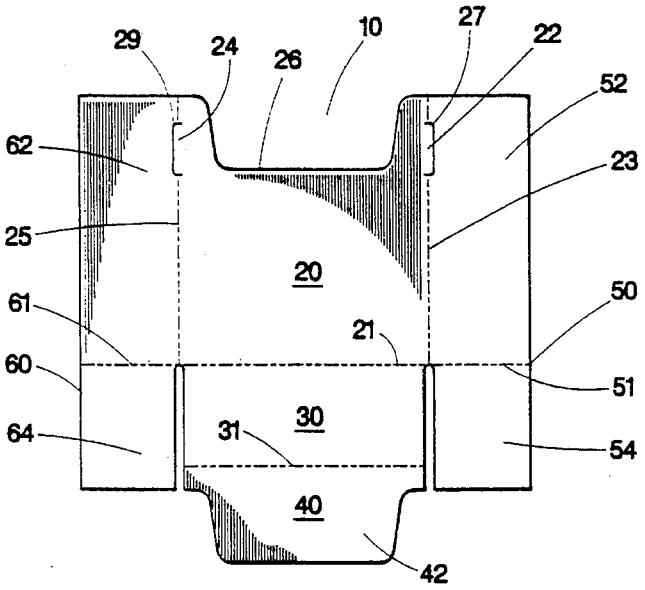
FIG. 1 depicts a folded-out blank for an innerframe according to a first embodiment of the present invention.

The present invention relates to step-shaped innerframes for packaging short cigarette bundles within a hinged lid box of conventional length. Such packaging permits tax stamping by conventional tax stamping machines without any modification for the different sized bundle. In addition, such an innerframe allows the cigarette bundle to be packaged within the hinged lid box, thereby providing a strong package for the short cigarette bundle.

The present invention comprises a front panel, a step bottom panel and a back panel. The front panel is foldably connected to the step bottom panel and the step bottom panel in turn is foldably connected to a back panel. The panels are folded such that the step bottom panel is substantially perpendicularly oriented to both the front panel and the back panel, and the front and back panels extend in opposite directions and lie in respective substantially parallel planes. Accordingly, the foldably connected front panel, step bottom panel and back panel form an integral step configuration. This step-shaped innerframe is located within a hinged lid box such that the end of the back panel or the front panel opposite the step bottom panel is fitted to the bottom wall of the hinged lid box.

The front panel or the back panel of the step-shaped innerframe extends to a point near the top hinged lid of the box. A top "L" portion is formed by this panel and the perpendicularly arranged step bottom panel to provide a support a cigarette bundle positioned therein. The step bottom panel divides the interior receptacle of the hinged lid box into an upper receptacle for holding the cigarette bundle and into a lower receptacle.

In one embodiment, the front panel of the innerframe lies adjacent to an upper portion of the inner side of the front wall of a hinged lid box and the back panel lies adjacent to the inner side of the back panel of the hinged lid box. In another embodiment, the front panel of the innerframe lies adjacent to a lower portion of the front wall of the box and the back panel lies adjacent to the upper portion of the back wall of the box. In other words, the first and second embodiments are fundamentally mirror images when viewed from the same side. See, e.g., FIGS. 4 and 10.

The front and back panels are face-to-face with the respective adjacent inner surfaces of the hinged top box to provide a stable support for the cigarette bundle resting on the step bottom panel. Since the short cigarette bundle has a shorter length than conventional cigarette, a lower receptacle is formed between the step bottom panel of the innerframe and the bottom wall of the hinged lid box. The present invention utilizes this space by providing a side hole in one of the side walls of the hinged lid box, or a hole in the front or back wall of the hinged lid box, and any associated innerframe panels, to provide access to the lower receptacle. The smoker may discard the used short cigarettes into this space via the hole, thereby providing a convenient receptacle for future disposal of the box along with all previously discarded cigarettes.

The step-shaped innerframe is preferably provided with oppositely located and substantially parallel side walls which lie adjacent to the side walls of the hinged lid box when the innerframe is inserted therein. In one embodiment, these side walls are each provided with biasing flaps which extend from a respective side wall at the step bottom panel of the innerframe and lie against the inserted short cigarette bundle. As short cigarettes are used by the smoker, these biasing flaps extend inward in a biased manner toward the remaining short cigarettes to prevent the remaining short cigarettes from falling completely over. In another embodiment, these side walls have a bottom end which abuts the bottom panel of the hinged lid box and extend to the top of the hinged lid box to provide stability to the supporting bottom panel of the innerframe.

The front panel preferably has cut-out a portion or recess to allow access to the short cigarettes supported by the innerframe. The bottom panel of the innerframe preferably has a corresponding extension to this cut out portion to permit blanks to be formed which utilizes the innerframe material efficiently.

The front panel may also have oppositely located tabs near its upper portion to engage the lid to maintain a closed configuration.

Figure 7:
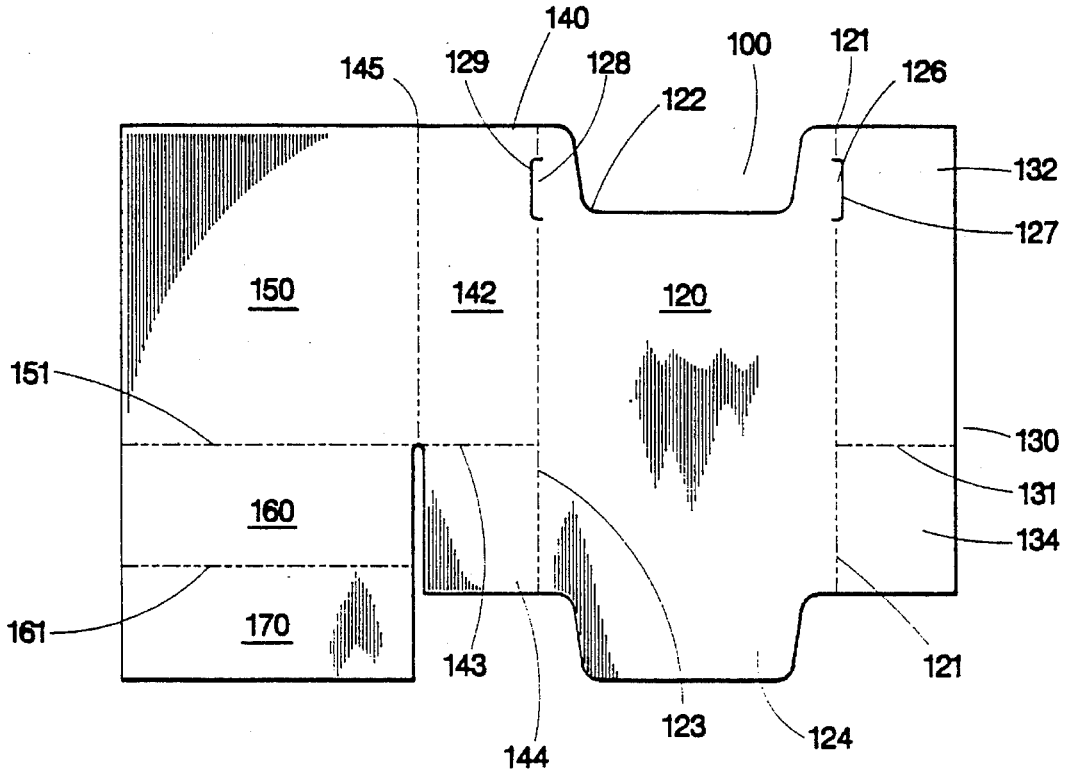
FIG. 7 depicts a folded-out blank for an innerframe according to a second embodiment of the present invention.

Referring to FIG. 1, a blank 10 is shown for a first embodiment of the present invention. Blank 10 may be made from any conventional material such as, e.g., cardboard, paper or plastic. Blank 10 comprises various sections integrally formed and foldably connected to one another via fold score lines or removably attached to one another via perforated or partially scored lines which are described as horizontal or vertical as shown in FIGS. 1 and 7. All horizontal lines are substantially parallel to one another and substantially perpendicular to the vertical lines, which are also substantially parallel to one another.

For ease of understanding, a component of the blank will be referred to as a panel section in blank form and a panel when the blank is formed into an innerframe. Also, the adverb "substantially" means respective components are oriented within desired tolerances.

Blank 10 comprises a front panel section 20, a step bottom panel section 30 and a back panel section 40. Front panel section 20 is foldably connected to one edge of bottom panel 30 via a substantially horizontal fold line 21. Bottom panel section 30 is foldably connected to an opposite edge of back panel section 40 via a substantially horizontal fold line 31. As shown in FIG. 1, the front panel section 20 has a curved or recessed top portion 26. Back panel section 40 has an integrally formed extended bottom portion 42 preferably having an area equal to the recessed top portion 26 of the front panel to utilize the material of blank 10 in an efficient manner.

A side panel section 50, located to the right in FIG. 1, is foldably connected to the front panel section 20 via a substantially vertical fold line 23 and comprises an upper portion 52 which is foldably connected to the front panel section via the length of substantially horizontal fold line 21 and a lower portion 54 which in one embodiment is integrally formed with upper portion 52 and in another embodiment in foldably connected to upper position 52 via substantially horizontal fold line 51. Bottom portion 54 of side panel section 50 extends along the right sides of step bottom panel section 30 and back panel section 40 and terminates at a bottom end which lies in line with the portion of back panel 40 where extended bottom portion 42 begins. A slit, represented in FIG. 1 as a wider groove for the purpose of clarity, is cut between the lower portion 54 and both the step bottom panel 30 and back panel 40 to permit folding as described below.

A side panel section 60, located to the left of front panel 20 in FIG. 1, is foldably connected to the front panel section along substantially vertical fold line 25. Side panel section 60 comprises an upper portion 62 which is foldably connected to front panel 20 via fold line 25 and a lower portion 64 which in one embodiment is integrally formed with upper portion 62 and in another embodiment is foldably connected to upper portion 62 via a substantially horizontal fold line 61. A cut slit, represented as before as a wider groove for clarity, is formed between the lower portion 64 and left edges of both step bottom panel section 30 and the back panel section 40 to permit folding as described below. Preferably, fold lines 61, 21 and 51 are in line. Side panel section 60 is preferably the same size as side panel section 50.

Right and left retention tabs 22 and 24 are integrally formed on upper portions of the opposite right and left sides of the front panel 20 and extend outward, i.e., to the right and left, respectively, of fold lines 23 and 25. Right and left retention tabs are removably attached to respective right and left side panels 50 and 60 via respective detachment, e.g., perforated or partially scored, lines 27 and 29.

Figure 2:
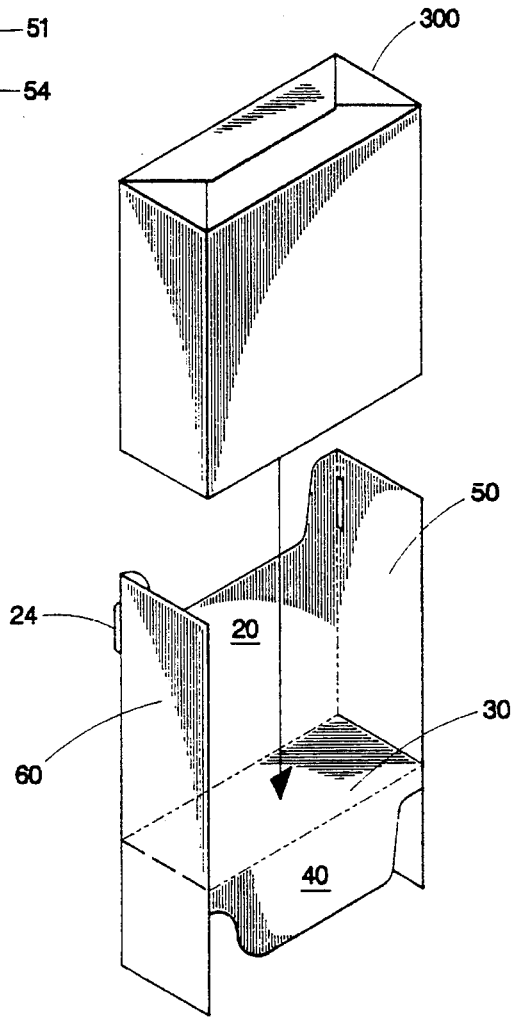
FIG. 2 is a rear perspective of the formed innerframe according to the first embodiment of the present invention formed about the cigarette bundle.

Referring to FIG. 2, the step-shaped innerframe of the first embodiment is formed by folding front panel 20 along fold line 21 to be in a substantially perpendicular relationship with connected bottom step panel 31. Next, back panel 40 is folded along fold line 31 to be in a substantially perpendicular relationship with connected step bottom panel 30 such that front panel 20 and back panel 40 lie in substantially parallel planes with respect to each other and extend in opposite directions. Next, side panels 50 and 60 are folded along fold lines 51 and 61 such that they lie substantially perpendicularly to substantially parallel front and back panels as well as substantially perpendicularly to bottom panel 30, wherein side panels 50 and 60 are substantially parallel. Right and left retention tabs 22 and 24 are detached from the side panels 50 and 60 and extend outwardly from front panel 20 in substantially the same plane as the front panel.

Figure 3:
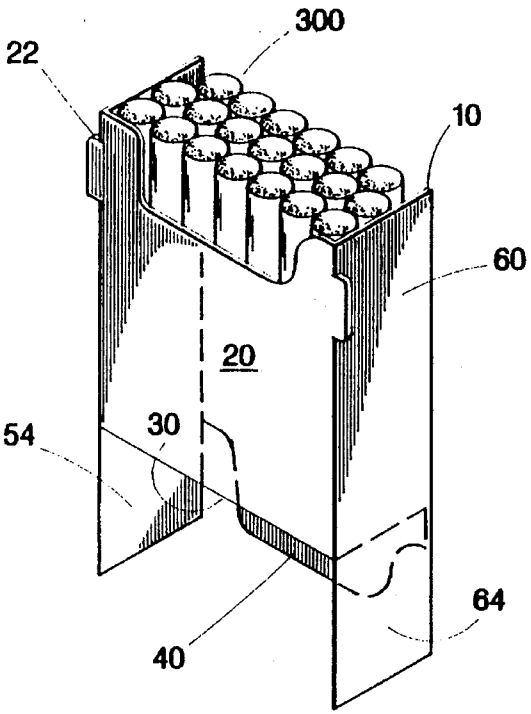
FIG. 3 is a front perspective of the innerframe according to the first embodiment of the present invention formed about the cigarette bundle.

A cigarette bundle receptacle is defined by the inner walls of front panel 20 and the upper portions 52 and 62 of side panels 50 and 60 and an upper side of step bottom panel 30. The innerframe is preferably formed around a bundle of vertically oriented cigarettes such that the cigarette bundle receptacle partially surrounds the cigarette bundle, as shown in FIG. 3. The hinged lid box is then preferably formed around the innerframe and cigarette bundle located therein.

Figure 6:
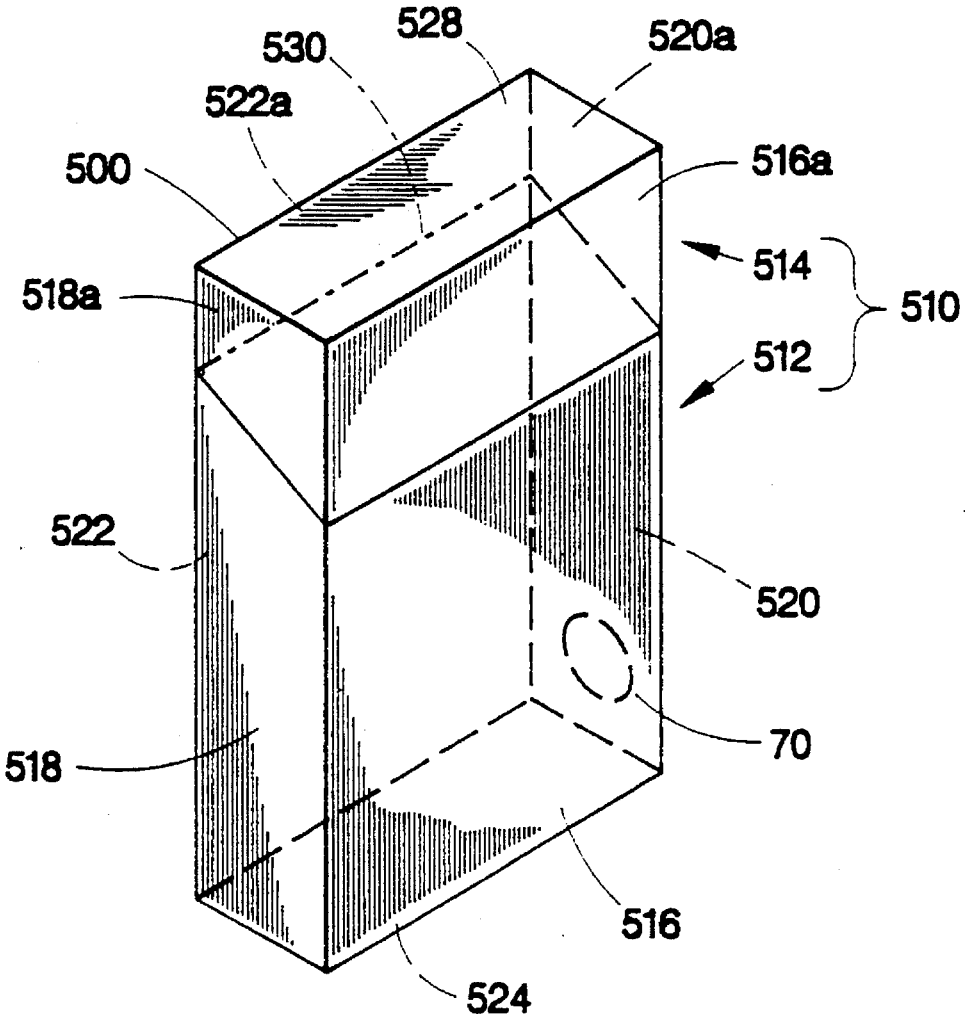
FIG. 6 is a front perspective of a hinged lid box according to the present invention.

As shown in FIG. 6, a hinged lid box type cigarette pack 500 includes an outer member 510 comprised of exterior walls formed of a substantially stiff material, such as 0.010–0.014 inch thick paperboard or cardboard, preferably 0.012 inch thick paperboard or cardboard. Outer member 510 has a lower main portion 512 and an upper lid portion 514. Main portion 512 has a front wall 516, a left side wall 518, a right side wall 520, a rear wall 522, and a bottom wall 524. Front wall 516 is typically shorter than rear wall 522. Lid 514 has a similar front wall 516*a*, left side wall 518*a*, right side wall 520*a*, and rear wall 522*a* which respectively correspond to and function as continuations of the similarly named main portion walls when the lid is closed as shown in FIG. 6. In addition, lid 514 has a top wall 528. Lid 514 is typically hinged to main portion 512 along hinge line 530 where rear walls 522 and 522*a* meet one another.

Hinged lid box 500 is preferably formed around the vertical stepped innerframe 10 which in turn is formed around cigarette bundle 300 as shown in FIG. 3. The cigarette bundle has a shorter axial length or height than the box. The cigarette bundle has a shorter axial length or height than the box. Specifically, as shown in FIG. 4, back wall 522 is arranged in a face-to-face relationship with back panel 40 of the innerframe, right and left walls 512 and 518 are arranged in a face-to-face relationship with right and left side panels 50 and 60 of the innerframe, and front wall 516 is arranged in a face-to-face relationship with front panel 20.

More specifically, front panel 20 of the innerframe is in face-to-face contact with an upper portion of the front wall 520 and back panel 40 is in face-to-face contact with the lower portion of back wall 522. Bottom step panel 30 divides the interior receptacle of the hinged lid box into an upper receptacle and a lower receptacle. The upper receptacle is defined by a top-facing side of the bottom step panel 30, an inner side of front panel 20, inner sides of side panels 50 and 60, an inner side of the upper portion of the back wall 522 of the box, and inner side of the closable lid 514. The lower receptacle is defined by a bottom-facing side of the bottom step panel 30, the inner side of the back panel 40, the inner sides the side walls 50 and 60, and inner sides of the lower portion of the front box wall 516 and the bottom box wall 524.

Figure 4:
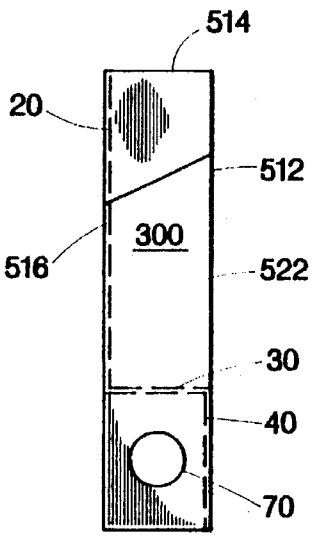
FIG. 4 is a side view of the innerframe according to the first embodiment of the present invention located within a hinged lid box.

Referring to FIG. 4, the cigarette bundle 300 is seen to be supported by the step-shaped innerframe comprising front panel 20, step bottom panel 30 and back panel 40. The upper receptacle is sized so that lid 514 is closable over cigarette bundle 300 and front panel 20. Retention tabs 22 and 24 are biased outward toward the inner sides of the lid to keep the lid firmly mated with the mating edges of the lower box portion. As best seen in FIG. 3, recessed area 26 permits access to the cigarettes when lid 514 and any bundle wrapper is opened.

Referring once again to FIG. 4, a hole 70 is provided in side wall 518, side wall 520, front wall 516 or back wall 522, as well as in any associated underlying panel of the innerframe, to provide access to the lower receptacle. The smoker may discard the used short cigarettes into this lower receptacle via hole 70, thereby providing a convenient receptacle or discard compartment for future disposal of the pack box and all previously discarded cigarettes contained therein. Access hole 70 is preferably located through either side wall 518 or 520, and through associated lower portions of side panels 64 and 54 (shown in FIG. 5) of the innerframe, in the embodiment depicted in FIG. 3 to provide access to the discard compartment. This discard compartment is preferably treated with a flame retardant layer. If not, then the cigarettes should be extinguished before discarding. In addition, this discard compartment preferably forms an odor barrier between the discarded cigarettes and the cigarette bundle by, e.g., coating step bottom panel 30 with an appropriate barrier.

Figure 5:
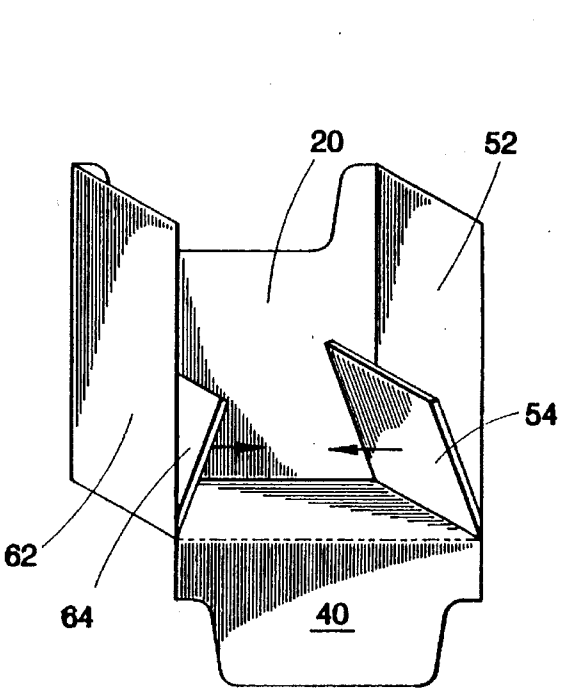
FIG. 5 is a rear perspective of biased members of the first embodiment directing an inward force on cigarettes (not shown) to prevent remaining cigarettes from falling as other cigarettes are removed.

In a preferred embodiment of the present invention shown in FIG. 5, lower portion 54 of side panel 50 and lower portion 64 of side panel 60 are folded approximately 180 degrees along the respective substantially horizontal fold lines 51 and 61 to lie against, i.e., to be folded toward, upper portions 52 and 62, such that the lower portions 54 and 64 are biased inwardly toward cigarette bundle 300. As the smoker removes the short cigarettes via top curved access portion 26, the biased bottom portions 54 and 64 exert a generally inwardly directed force against the remaining cigarettes in bundle 300, thereby preventing the remaining cigarettes from falling completely over as other cigarettes are removed, i.e., the remaining cigarettes are maintained substantially upright. Since the cigarettes are shorter than conventional cigarettes but of similar diameter and packing arrangement, a short cigarette could otherwise fall over substantially or completely, complicating retrieval and potentially damaging the cigarette.

The previously described invention provides a step-shaped innerframe wherein the blank comprises side panels which are vertically oriented with respect to the front panel, bottom and back panels in the blank. A second embodiment of the present invention employs a so-called "wrap around" blank for step-shaped innerframe.

Referring to FIG. 7, a blank 100 is shown. Blank 100 comprises a front panel section 120 having an integrally formed top recessed portion 122 similar to that described to that above with respect to recessed top portion 26. At an opposite end, front panel 120 has an integrally formed bottom extension 124 which corresponds to the extended bottom portion 42 of FIG. 1 of back panel 40, i.e., bottom extension 124 preferably has an area equal to that of the recessed portion 122.

A first side panel section 130 is foldably connected to an edge of front panel section 120, e.g., to the right in FIG. 7, via a substantially vertical fold line 121. Side panel section 130 comprises an upper portion 132 and a lower portion 134 that in one embodiment functions as a biasing member as described below. If so, a substantially horizontal fold line 131 separates upper portion 132 from lower biasing portion 134. If not, upper and lower sections 132 and 134 are integrally formed. Lower section 134 extends to a point where bottom extension 124 begins.

A second side panel section 140 is located opposite to side panel section 130, i.e., to the left in FIG. 7, and is foldably connected to front panel 120 via a substantially vertical fold line 123. Side panel sections 130 and 140 are preferably of the same size and geometric configuration. Side panel section 140 also comprises an upper portion 142 and a lower portion 144 which may serve as a biasing member. If so, a perforated or scored fold line 143 separates the upper portion 142 from the lower biasing portion 144. If not, upper and lower portions are integrally formed. Lower biasing portion 144 terminates evenly with lower portion 134 of the other side panel.

Right and left retention tabs 126 and 128 are integrally formed on opposite sides of an upper portions of the right and left side of the front panel 120 and are respectively removably attached to side panel portions 132 and 142 via perforated or partially scored lines 127 and 129.

A step section comprising a back panel section 150, a step bottom panel section 160 and a front step panel section 170 is foldably connected to the side panel section 140 via a substantially vertical perforated or scored fold line 145. Specifically, back panel section 150 is foldably connected to side panel section 140 via fold line 145 located along an edge of back panel section 150 opposite fold line 123. Step bottom panel section 160 is foldably connected to back panel section 150 via a substantially horizontal fold line 151 which is substantially perpendicular to fold line 145. Front step panel section 170 is foldably connected to step bottom panel section 160 via substantially horizontal fold line 161 which is opposite to fold line 151. As shown in FIG. 7, the top edge of back panel section 150 is even with the top edge of side panel sections 130 and 140 as well as front panel section 120. The bottom edge of front step panel section 170 is in line with the bottom-most extension of bottom edge 124. A slit, represented by a wider groove in FIG. 7 for clarity, is cut between lower portion 144 of side panel section 140 and both step bottom panel 160 and front step panel 170 to permit folding as described below.

Figure 8:
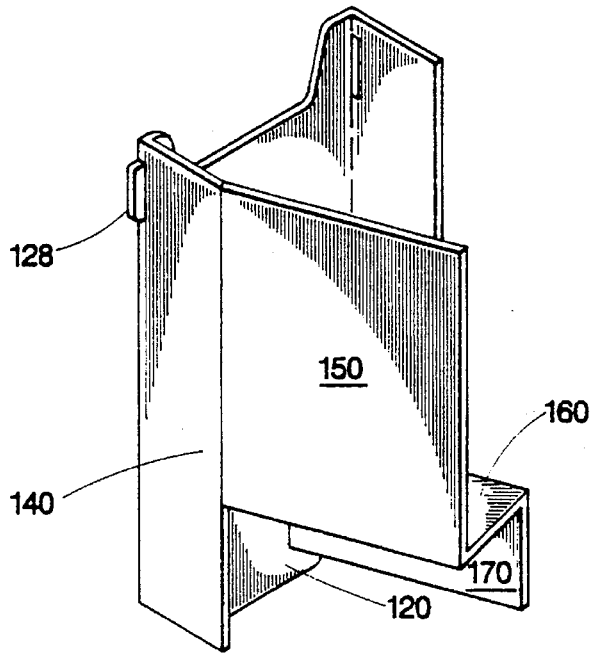
FIG. 8 is perspective of the formed innerframe according to the second embodiment of the present invention formed about the cigarette bundle.

Referring to FIG. 8, the blank of FIG. 7 is folded into a wrap-around step innerframe according to the present invention. Specifically, side panel 130 is folded along fold line 121 at such that it is substantially perpendicularly oriented with respected to connected front panel 120. Likewise, side panel 140 is folded along fold line 123 such that it is substantially perpendicularly oriented with respect to front panel 120 and faces oppositely located side panel 130 in a substantially parallel arrangement. Retention tabs 126 and 128 are detached from side panels 130 and 140 and extend outward from front panel 120 in substantially the same plane as the front panel.

Wrap-around step innerframe portion is next formed. Specifically, step bottom panel 160 is folded fold line 151 such that bottom panel 160 is arranged substantially perpendicularly to back panel 150. The slit, represented by a wider groove in FIG. 7 for clarity, cut between lower portion 144 of side panel section 140 and both step bottom panel 160 and front panel 170 permits folding. Front step panel 170 is folded along fold line 161 such that it is substantially perpendicular with respect to connected bottom panel 160 and is substantially parallel to and extends in the opposite direction to back panel 150, thereby forming a step-shaped innerframe.

Figure 9:
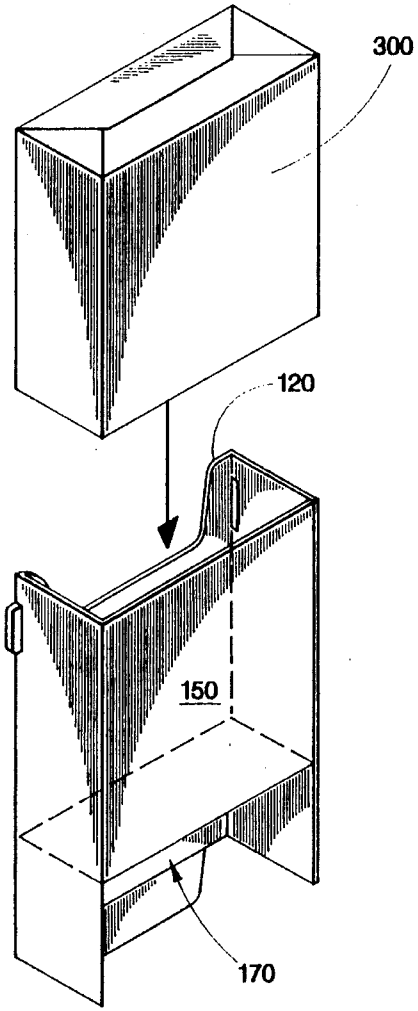
FIG. 9 is a front perspective of the innerframe according to the second embodiment of the present invention formed about the cigarette bundle.

Wrap around step innerframe portion, and specifically back panel 150, is folded along perforated or scored fold line 141 such that back panel 150 is oriented substantially perpendicularly with respect to both side panels 140 and 130 and located in a substantially parallel arrangement with oppositely located front panel 120, thereby forming a receptacle around the short cigarette bundle 300, as shown FIG. 9. Front step panel 170 abuts the lower portion of front panel 120 in a face-to-face relationship.

As shown in FIG. 9, the short cigarette bundle 300 is contained with the recess formed by inner sides of the upper portion of front panel 120, the upper portions 132 and 142 of side panels 130 and 140, and back panel 150, and a top side of bottom step panel 160. The right and left retention tabs 126 and 128 engage with the lid inner side to assist in maintaining a closed position. As before, the top recess 122 of front panel 120 allows access to the cigarettes contained in the short cigarette bundle when the box lid is opened.

Figure 10:
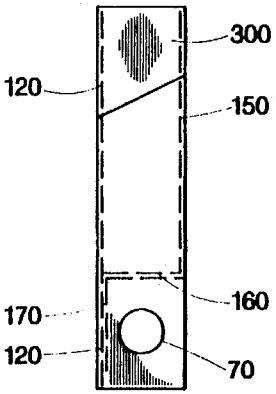
FIG. 10 is a side view of the innerframe according to the second embodiment of the present invention located within a hinged lid box.

This innerframe is located within a hinged lid box, as shown in FIG. 10. Specifically, the formed stepped innerframe is located within the hinged lid box such that the coextensive bottom extension 124 of the front panel 120 and the front step panel 170 abut the bottom wall 524 of the hinged lid box.

Specifically, the conventional hinged lid box 500 is formed around the innerflame 100 in the same manner as described above with respect to innerframe 10. The back panel 150 of the innerframe 100 abuts an inner side of an upper position the back wall 522 of the box in a face-to-face contact. Side walls 520 and 518 respectively overlie side panels 130 and 140 of the innerframe in a face-to-face contacting relationship. Front panel 120 of the innerflame contacts the inner side and the front wall 516 of the box in a face-to-face relationship. Accordingly, lid 514 may be closed over the cigarette bundle 300 resting in the upper receptacle formed by the innerframe 100.

As described previously, the hinged lid box 550 is preferably modified to have a discard hole 70 located through a wall, and any associated panel of the innerframe, at a location below the step bottom panel 160 for discarding cigarettes after use into a discard compartment defined by a bottom side of step bottom panel 160, inner sides of lower portions 134 and 144 of side panels 130 and 140, an inner side of front step panel 170, and inner sides of rear wall 522 and bottom wall 524 of the box. Preferably, this discard hole is located in one of the side walls 512 or 518 and associated side panel portions 134 or 144.

Figure 11:
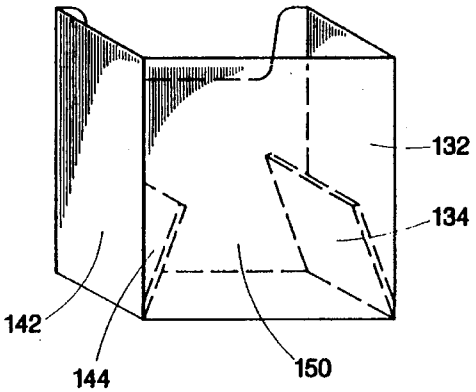
FIG. 11 is a rear perspective of biased members of the second embodiment for directing an inward force on cigarettes (not shown) to prevent remaining cigarettes from falling as other cigarettes are removed.

As described previously with respect to the first embodiment, the lower portions 134 and 144 of side panels 130 and 140 may be folded 180 degrees along fold line 131 and 141 such that they lie substantially adjacent to top portions 132 and 142 and are biased inwardly toward inserted cigarette bundle 300 to prevent the remaining cigarettes from fall as cigarettes are removed for use as shown in FIG. 11 with the lower panels absent for clarity.

The described step-shaped innerframes 100 and 200 possess sufficient mechanical integrity to support itself and the cigarette bundle within the hinged lid box. For example, the back panel 40 of innerframe 100 and the front panel 120 and front step panel 170 of innerframe 200 can bottom out on bottom wall 524. The respective side panels can also extend to the bottom of the box. Alternatively or in conjunction with this configuration, glue, adhesive or other conventional attachment mechanisms are employed between the panels and the inner sides of lower portion 512 of the hinged lid box. For example, glue spots can be applied between front panel 20 and front wall 516; between back panel 40 and back wall 522; and/or between side panels 50 and 60 and side walls 518 and 520. Similarly, glue spots can be applied between front panel 120 and front wall 516; between back panel 150 and back wall 522; between side panels 130 and 140 and side walls 518 and 520; and/or between front panel 120 and front step panel 170.

The present invention accordingly provides step-shaped innerframes for supporting a shorter than conventional cigarette bundle within a conventionally sized hinged lid box. The remaining space of the hinged lid box not occupied by the shorter than conventional cigarette bundle is effectively utilized as a discard space via the provision of a discard hole in one of the side walls located beneath the bottom step panel of the innerframe supporting the cigarette bundle. A mechanism is provided to maintain the shorter cigarettes substantially upright. The step innerframes are formed from blanks which utilize material in an efficient manner. These blanks also permit formation of the step-shaped innerframes in a straightforward manner.

Many modifications, substitutions and improvements will be apparent to the skilled artist without departing from the spirit and scope of the present invention as described and defined in the preceding specification in the following claims.

We claim:

1. A step-shaped innerframe for supporting a bundle of cigarettes within a box comprising an interconnected front wall, back wall, first and second side walls, bottom wall, and top wall, the bundle of cigarettes having a shorter height than the box, the step-shaped innerframe comprising:

a front panel;

a back panel located opposite said front panel in a substantially parallel relationship;

a bottom step panel substantially perpendicularly connected to said back panel; and a front step panel substantially perpendicularly connected to said bottom step panel such that said front step panel and said back panel are substantially parallel and extend in opposite directions from said bottom step panel;

wherein said bottom step panel contacts said front panel substantially perpendicularly to divide said front panel into an upper portion and lower portion, and wherein said front step panel contacts the lower portion of said front panel in a face-to-face contact;

wherein an upper side of said bottom step panel, and the inner sides of the upper portion of said front panel and of said back panel define a receptacle sized for the cigarette bundle.

2. The step-shaped innerframe according to claim 1 wherein the front panel defines an aperture for access to the cigarette bundle when the top wall of the box is opened.

3. The step-shaped innerframe according to claim 2 further comprising two side panels, each side panel substantially perpendicularly connected to said front panel, each side panel located opposite to the other side panel in a substantially parallel relationship, wherein inner sides of the two side panels further define a receptacle sized for the cigarette bundle.

4. The step-shaped innerframe according to claim 3 wherein each side panel extends beyond said bottom step panel and is substantially perpendicular with respect to said front panel.

5. The step-shaped innerframe according to claim 3 wherein at least one of the first and second side panels further comprises a biased member biased inwardly, wherein the biased member exerts an inwardly directed force on the cigarette bundle to prevent individual cigarettes of the cigarette bundle from falling as other individual cigarettes are removed from the bundle.

6. The step-shaped innerframe according to claim 5 wherein the biased member of said at least one side panel comprises a flap foldably connected to an associated side panel, wherein said flap is folded toward the associated side panel when a full cigarette bundle is located therein and said flap exerts an inward force on the cigarette bundle.

7. The step-shaped innerframe according to claim 5 wherein said biased member comprises at least one flap foldably connected to one of said two side walls via a fold line, wherein said at least one flap is folded approximately 180 degrees via the fold line toward the one side wail when the predetermined initial number of vertically oriented cigarettes is within the receptacle, said at least one flap exerting an inward force on the vertically oriented cigarettes, wherein as cigarettes are removed from the receptacle, said at least one flap unfolds to maintain the vertical orientation of the remaining cigarettes.

8. The step-shaped innerframe according to claim 7 wherein said at least one flap is foldably connected to one of said two side walls via a substantially horizontal fold line, wherein the flap is folded via the substantially horizontal fold line toward the one side wall when the predetermined initial number of vertically oriented cigarettes is within the receptacle as the flap exerts an inward force on the vertically oriented cigarettes.

9. The step-shaped innerframe according to claim 5 further comprising two flaps, each flap foldably connected to an associated one of said two side walls via a respective fold line, wherein each flap is folded approximately 180 degrees via the respective fold lines toward the associated one of said two side walls when the predetermined initial number of vertically oriented cigarettes is within the receptacle and each flap exerts an inward force on the vertically oriented cigarettes.

10. The step-shaped innerframe according to claim 8 wherein said front panel further comprises two side extension tabs extending outward from said front panel.

11. The step-shaped innerframe according to claim 9 wherein each flap is foldably connected to an associated one of said two side walls via a respective substantially horizontal fold line, wherein each flap is folded approximately 180 degrees via the respective substantially horizontal fold line toward the associated side wall when the predetermined initial number of cigarettes is located within the receptacle.

12. A hinged lid box for packaging a cigarette bundle comprising:

a front exterior wall;

a back exterior wall;

two side exterior walls;

a bottom exterior wall, wherein said front, back, bottom and side exterior walls are interconnected to form an interior receptacle;

a top lid hingably connected to the back exterior wall to close the defined interior receptacle, wherein the cigarette bundle has a shorter height than the front, back and side exterior walls; and an innerframe located with the interior receptacle comprising:

a front panel contacting the inner side of said front exterior wall in a face-to-face relationship;

a front step panel contacting a lower portion of the inner side of said front panel;

a bottom step panel substantially perpendicularly connected to an upper edge of said front step panel;

a back panel contacting an upper portion of the inner side of the back exterior wall, said back panel substantially perpendicularly connected to said bottom step panel such that said back panel and said front step panel extend in opposite directions in a substantially parallel manner;

wherein said bottom step portion divides the interior receptacle into an upper receptacle defined by said bottom step panel and inner sides of said front exterior wall, said side exterior walls, and said back panel, the upper receptacle sized to receive the cigarette bundle, and into a lower receptacle defined by said bottom step panel, said front step panel, said side exterior walls, said back exterior wall, and said bottom exterior wall.

13. The hinged lid box according to claim 12 wherein the front panel defines an aperture for access to the cigarette bundle when the top lid of the hinged lid box is opened.

14. The hinged lid box according to claim 13 further comprising two side panels, each side panel substantially perpendicularly connected to said front panel, each side panel located opposite to the other side panel in a substantially parallel relationship, wherein each of said side panels respectively contacts the inner sides of one of the first and second side walls of the box in a face-to-face contact.

15. The hinged lid box according to claim 14 wherein side panel extends beyond said bottom step panel and is substantially perpendicular with respect to said front panel and said front step panel wherein the bottom edges of said side panels abut the bottom exterior wall.

16. The hinged lid box according to claim 14 wherein at least one of the first and second side panels further comprises a biased member biased inwardly; wherein the biased member exerts an inwardly directed force on the cigarette bundle to prevent individual cigarettes of the cigarette bundle from falling as individual cigarettes are removed from the bundle.

17. The hinged lid box according to claim 16 wherein the biased member of at least one of said side panels comprises a flap foldably connected to an associated side panel, wherein said flap is folded toward the associated side panel when a full cigarette bundle is located therein and said flap exerts an inward force on the cigarette bundle.

18. The hinged lid box according to claim 12 wherein said front panel of the innerframe further comprises two side extension tabs extending outward from said front panel, said side extension tabs engaging said lid when closed.

19. The hinged lid box according to claim 12 wherein a bottom edge of said back panel abuts the bottom exterior wall.

20. The hinged lid box according to claim 12 further comprising adhesive between at least one of said front panel and said back panel and the respective contacting front exterior wall and back exterior wall.

21. The hinged lid box according to claim 14 further comprising an adhesive placed between at least one of said side panels and the respective contacting side exterior walls.

22. The hinged lid box according to claim 16 wherein said biased member comprises at least one flap foldably connected to one of said two side walls via a fold line, wherein said at least one flap is folded approximately 180 degrees via the fold line toward the one side wall when the predetermined initial number of vertically oriented cigarettes is within the receptacle, said at least one flap exerting an inward force on the vertically oriented cigarettes, wherein as cigarettes are removed from the receptacle, said at least one flap unfolds to maintain the vertical orientation of the remaining cigarettes.

23. The hinged lid box according to claim 21 wherein said at least one flap is foldably connected to one of said two side walls via a substantially horizontal fold line, wherein the flap is folded via the substantially horizontal fold line toward the one side wall when the predetermined initial number of vertically oriented cigarettes is within the receptacle as the flap exerts an inward force on the vertically oriented cigarettes.

24. The hinged lid box according to claim 16 comprising two flaps, each flap foldably connected to an associated one of said two side walls via a respective fold line, wherein each flap is folded approximately 180 degrees via the respective fold lines toward the associated one of said two side walls when the predetermined initial number of vertically oriented cigarettes is within the receptacle and each flap exerts an inward force on the vertically oriented cigarettes.

25. The hinged lid box according to claim 24 wherein each flap is foldably connected to an associated one of said two side walls via a respective substantially horizontal fold line, wherein each flap is folded approximately 180 degrees via the respective substantially horizontal fold line toward the associated side wall when the predetermined initial number of cigarettes is located within the receptacle.

26. A blank for forming a step-shaped innerframe for supporting a bundle of cigarettes within a box, the bundle having a shorter height than the box, the blank comprising:

a front panel section;

first and second side panel sections, each comprising a respective first section and a respective second section foldably connected to said front panel via respective first and second substantially vertical fold lines;

a back panel section foldably connected to the first section of said first side panel section via a third substantially vertical fold line;

a bottom step panel section foldably connected to said back panel section via a first substantially horizontal fold line;

a front step panel section foldably connected to said bottom step panel section via a second substantially horizontal fold line;

wherein a slit is formed between the second section of said first side panel section and both said bottom step panel section and said front step panel section.

27. The blank according to claim 26 wherein front panel section further comprises integrally formed first and second extension tabs removably attached to respective first and second side panel sections.

28. The blank according to claim 26 wherein the first and second sections of each side wall section are foldably connected by a respective third and fourth substantially horizontal fold lines.

29. A receptacle for containing vertically oriented cigarettes comprising:

a front wall;

a back wall substantially parallel to said front wall;

two side walls, each side wall substantially perpendicularly connected to both said front wall and to said back wall, each side wall substantially parallel to the other side wall;

a bottom wall substantially perpendicularly connected both to said front and back walls and to said two side walls;

wherein said front, back, side, and bottom walls define a receptacle sized to hold a predetermined initial number of cigarettes in an initial vertical orientation; and at least one flap foldably connected to one of said two side walls via a fold line, wherein said at least one flap is folded approximately 180 degrees via the fold line toward the one side wall when the predetermined initial number of vertically oriented cigarettes is within the receptacle, said at least one flap exerting an inward force on the vertically oriented cigarettes, wherein as cigarettes are removed from the receptacle said at least one flap unfolds to maintain the vertical orientation of the remaining cigarettes.

30. The receptacle according to claim 28 wherein said at least one flap is foldably connected to one of said two side walls via a substantially horizontal fold line, wherein the flap is folded via the substantially horizontal fold line toward the one side wall when the predetermined initial number of vertically oriented cigarettes is within the receptacle and the flap exerts an inward force on the vertically oriented cigarettes.

31. The receptacle according to claim 28 comprising two flaps, each flap foldably connected to an associated one of said two side walls via a respective fold line, wherein each flap is folded approximately 180 degrees via the respective fold line toward the associated side wall when the predetermined initial number of cigarettes is located within the receptacle and each flap exerts an inward force on the vertically oriented cigarettes.

32. The receptacle according to claim 30 wherein each flap is foldably connected to an associated one of said two side walls via a respective substantially horizontal fold line, wherein each flap is folded approximately 180 degrees via the respective substantially horizontal fold line toward the associated side wall when the predetermined initial number of cigarettes is located within the receptacle.

33. A pack for packaging a cigarette bundle comprising:

a front wall;

a back exterior wall;

two side exterior walls;

a bottom exterior wall, wherein said front, back, bottom and side exterior walls are interconnected to form an interior receptacle, wherein the cigarette bundle has a shorter height than the front, back and side exterior walls;

a top portion connected at least to said back exterior wall to close the defined interior receptacle; and an innerframe located with the interior receptacle comprising:

a front panel contacting the inner side of said front exterior wall in a face-to-face relationship;

a front step panel contacting a lower portion of the inner side of said front panel;

a bottom step panel substantially perpendicularly connected to an upper edge of said front step panel;

a back panel contacting an upper portion of the inner side of the back exterior wall, said back panel substantially perpendicularly connected to said bottom step panel such that said back panel and said front step panel extend in opposite directions in a substantially parallel manner;

wherein said bottom step portion divides the interior receptacle into an upper receptacle defined by said bottom step panel and inner sides of said front exterior wall, said side exterior walls, and said back panel, the upper receptacle sized to receive the cigarette bundle, and into a lower receptacle defined by said bottom step panel, said front step panel, said side exterior walls, said back exterior wall, and said bottom exterior wall.

34. The pack according to claim 33 wherein the front panel defines an aperture for access to the cigarette bundle.

35. The pack according to claim 33 wherein said innerframe further comprises first and second side panels, each side panel substantially perpendicularly connected to said front panel of the innerframe and located oppositely and substantially parallel to the other side panel, wherein the inner sides of said side panels, back panel and front panel, and said bottom step panel form the upper receptacle for the cigarette bundle.

36. The pack according to claim 35 wherein each side panel extends beyond said step bottom panel and is substantially perpendicular to said back panel, a bottom edge of each side panel abutting the bottom exterior wall.

37. The pack according to claim 33 wherein at least one of the first and second side panels further comprises a biased member biased inwardly; wherein the biased member exerts an inwardly directed force on the cigarette bundle to prevent individual cigarettes of the cigarette bundle from falling as individual cigarettes are removed from the bundle.

38. The pack according to claim 37 wherein the biased member of at least one of said side panels comprises a flap foldably connected to an associated side panel, wherein said flap is folded toward the associated side panel when a full cigarette bundle is located therein and said flap exerts an inward force on the cigarette bundle.

39. The pack according to claim 37 wherein said biased member comprises at least one flap foldably connected to one of said two side walls via a fold line, wherein said at least one flap is folded approximately 180 degrees via the fold line toward the one side wall when the predetermined initial number of vertically oriented cigarettes is within the receptacle, said at least one flap exerting an inward force on the vertically oriented cigarettes, wherein as cigarettes are removed from the receptacle, said at least one flap unfolds to maintain the vertical orientation of the remaining cigarettes.

40. The pack according to claim 39 wherein said at least one flap is foldably connected to one of said two side walls via a substantially horizontal fold line, wherein the flap is folded via the substantially horizontal fold line toward the one side wall when the predetermined initial number of vertically oriented cigarettes is within the receptacle as the flap exerts an inward force on the vertically oriented cigarettes.

41. The pack according to claim 35 wherein the first and second side panels each further comprises a biased member biased inwardly, wherein the biased members exert an inwardly directed force on the cigarette bundle to prevent individual cigarettes of the cigarette bundle from falling as individual cigarettes are removed from the bundle.

42. The pack according to claim 41 wherein the biased member of each side panel comprises a flap foldably connected to an associated side panel, wherein each flap is folded toward the associated side panel when a full cigarette bundle is located therein and each flap exerts an inward force on the cigarette bundle.

43. The hinged lid box according to claim 41 further comprising two flaps, each flap foldably connected to an associated one of said two side walls via a respective fold line, wherein each flap is folded approximately 180 degrees via the respective fold lines toward the associated one of said two side walls when the predetermined initial number of vertically oriented cigarettes is within the receptacle and each flap exerts an inward force on the vertically oriented cigarettes.

44. The hinged lid box according to claim 43 wherein each flap is foldably connected to an associated one of said two side walls via a respective substantially horizontal fold line, wherein each flap is folded approximately 180 degrees via the respective substantially horizontal fold line toward the associated side wall when the predetermined initial number of cigarettes is located within the receptacle.

45. The pack according to claim 33 wherein an access aperture is provided to the lower receptacle.

46. The pack according to claim 45 wherein the access aperture is provided through one of said side exterior walls.

47. The pack according to claim 35 wherein an access aperture is provided to the lower receptacle.

48. The pack according to claim 47 wherein the access aperture is provided through one of said side exterior walls and an associated side panel.

49. The pack according to claim 33 wherein a bottom edge of said back panel abuts the bottom exterior wall.

50. The pack according to claim 33 further comprising adhesive between at least one of said front panel and said back panel and the respective contacting front exterior wall and back exterior wall.

51. The pack according to claim 35 further comprising an adhesive placed between at least one of said side panels and the respective contacting side exterior walls.

* * * * *